US007546917B1

(12) United States Patent
Lam et al.

(10) Patent No.: US 7,546,917 B1
(45) Date of Patent: Jun. 16, 2009

(54) PALLET ADAPTER AND DETONATION BARRIER FOR AMMUNITION

(75) Inventors: Yuen H. Lam, Morris Plains, NJ (US); William Paulo, Parsippany, NJ (US); John A. Sliker, Andover, NJ (US); Richard C. Dzury, Dover, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 685 days.

(21) Appl. No.: 11/161,479

(22) Filed: Aug. 4, 2005

(51) Int. Cl.
*F42B 39/00* (2006.01)
*B65D 1/36* (2006.01)

(52) U.S. Cl. ..... 206/3; 206/561; 206/565

(58) Field of Classification Search ..... 206/317, 206/501, 558, 561, 562, 564, 565, 503, 3; 220/552
See application file for complete search history.

(56) References Cited

U.S. PATENT DOCUMENTS 2,368,502 A * 1/1945 Troiel ..... 249/132
2,487,687 A * 11/1949 Arthur et al. ..... 108/57.14
2,670,984 A * 3/1954 Arthur ..... 294/67.3
2,935,206 A * 5/1960 Smith ..... 211/65
3,709,325 A * 1/1973 Gordon et al. ..... 206/392
3,820,679 A * 6/1974 Schweitzer ..... 220/507
4,222,484 A * 9/1980 Howe ..... 206/3
4,286,708 A * 9/1981 Porzel ..... 206/3
4,440,296 A * 4/1984 Howe et al. ..... 206/3
4,733,773 A * 3/1988 LaBianca et al. ..... 206/3
5,133,258 A * 7/1992 Rock et al. ..... 102/331
5,158,173 A * 10/1992 Halsey et al. ..... 206/3
5,213,211 A * 5/1993 Umiker ..... 206/392
5,360,115 A * 11/1994 Makino ..... 206/523
6,290,087 B1 * 9/2001 Shacklee ..... 220/582
6,577,699 B1 * 6/2003 Minshall ..... 376/272
6,684,591 B2 * 2/2004 Jean ..... 52/589.1
6,772,877 B1 * 8/2004 Lam et al. ..... 206/3

* cited by examiner

*Primary Examiner*—Jila M Mohandesi
*Assistant Examiner*—Sharon M Prange
(74) *Attorney, Agent, or Firm*—Michael C. Sachs

(57) ABSTRACT

An apparatus for packing containers includes a generally rectangular pallet adapter comprising rows and columns of cups, the rows and columns of cups being substantially orthogonal to each other, each cup comprising a lower portion that is generally circular and an upper portion that is generally rectangular, the pallet adapter including side walls located on its perimeter, the side walls extending upward beyond the cups; and a detonation barrier disposed on the pallet adapter, the detonation barrier the detonation barrier comprising internal row partitions, internal column partitions, two end row partitions and two end column partitions, the internal row partitions and end row partitions being substantially orthogonal to the internal column partitions and end column partitions thereby defining rows and columns of rectangular openings.

12 Claims, 14 Drawing Sheets

PALLET ADAPTER AND DETONATION BARRIER FOR AMMUNITION

STATEMENT OF GOVERNMENT INTEREST

The inventions described herein may be manufactured, used and licensed by or for the U.S. Government for U.S. Government purposes.

BACKGROUND OF THE INVENTION

The invention relates in general to apparatus for palletizing ammunition and, more particularly, to apparatus for palletizing ammunition and preventing sympathetic detonation.

U.S. Pat. No. 6,722,877 was issued on Aug. 10, 2004, and is hereby expressly incorporated by reference. The '877 patent discloses a cylindrical MONOPAQ™ container for ammunition, such as mortar ammunition. Prior to the MONOPAQ™ container, mortar ammunition was packaged in pairs in PA154 metal cans. Palletization of the PA154 cans comprised a wood pallet, often with another sheet of wood nailed on top of it. Twenty-four PA154 metal cans were placed on the pallet, allowing 48 cartridges to be palletized. However, this method of palletization does not work for the cylindrical MONOPAQ™ container. Further, this method is not able to ensure proper spacing of mortar cartridges for improved sympathetic detonation results. Due to the slender shape of the cylindrical MONOPAQ™ container, stabilizing devices for palletization are required for a steady load for transportation and storage.

SUMMARY OF THE INVENTION

One object of the invention is to provide an apparatus for palletization of MONOPAQ™ containers for ammunition such as 120 mm mortars.

Another object of the invention is to provide an apparatus for palletization of MONOPAQ™ containers that provides for a secure palletized load, as well as easy accessibility to ammunition by the soldier.

A further object of the invention is to provide a lightweight detonation barrier for palletized MONOPAQ™ containers that meets the sympathetic detonation (SD) requirement for a palletized load.

A first feature of the invention is a generally rectangular pallet adapter comprising rows and columns of cups, the rows and columns of cups being substantially orthogonal to each other, each cup comprising a lower portion that is generally circular and an upper portion that is generally rectangular, the pallet adapter including side walls located on its perimeter, the side walls extending upward beyond the cups.

A second feature of the invention is a generally rectangular pallet adapter comprising rows and columns of cups, the rows and columns of cups being substantially orthogonal to each other, each cup comprising a lower portion that is generally circular and an upper portion that is generally rectangular, the pallet adapter including side walls located on its perimeter, the side walls extending upward beyond the cups; and a detonation barrier disposed on the pallet adapter.

A third feature of the invention is a detonation barrier comprising internal row partitions, internal column partitions, two end row partitions and two end column partitions, the internal row partitions and end row partitions being substantially orthogonal to the internal column partitions and end column partitions thereby defining rows and columns of rectangular openings; the internal row partitions, end row partitions, end column partitions and internal column partitions each having vertical slots formed therein, a number of vertical slots in the internal row partitions and end row partitions being one less than a number of columns of rectangular openings and a number of vertical slots in the internal column partitions and end column partitions being one less than a number of rows of rectangular openings, a vertical slot in each of the internal column partitions mating with a corresponding vertical slot in each of the internal row partitions; each end row partition including at least one tab opening adjacent each side edge and each end column partition including at least one tab formed on each side edge, for insertion in the at least one tab opening; each side edge of the internal column partitions and each side edge of the internal row partitions including a stepped portion for receiving an end row partition and an end column partition, respectively, the stepped portion including a hook.

A fourth feature of the invention is a generally rectangular pallet adapter comprising rows and columns of cups, the rows and columns of cups being substantially orthogonal to each other, each cup comprising a lower portion that is generally circular and an upper portion that is generally rectangular, the pallet adapter including side walls located on its perimeter, the side walls extending upward beyond the cups; and a plurality of containers, one end of each container disposed in each cup, each container including a generally rectangular stacking index.

A fifth feature of the invention is a generally rectangular pallet adapter comprising rows and columns of cups, the rows and columns of cups being substantially orthogonal to each other, each cup comprising a lower portion that is generally circular and an upper portion that is generally rectangular, the pallet adapter including side walls located on its perimeter, the side walls extending upward beyond the cups; a plurality of containers, one end of each container disposed in each cup, each container including a generally rectangular stacking index; and a detonation barrier disposed on the pallet adapter.

A sixth feature of the invention is a first generally rectangular pallet adapter comprising rows and columns of cups, the rows and columns of cups being substantially orthogonal to each other, each cup comprising a lower portion that is generally circular and an upper portion that is generally rectangular, the first pallet adapter including side walls located on its perimeter, the side walls extending upward beyond the cups; a plurality of containers, one end of each container disposed in each cup, each container including a generally rectangular stacking index; a detonation barrier disposed on the first pallet adapter; and a second generally rectangular pallet adapter comprising rows and columns of cups, the rows and columns of cups being substantially orthogonal to each other, each cup comprising a lower portion that is generally circular and an upper portion that is generally rectangular, the second pallet adapter including side walls located on its perimeter, the side walls extending upward beyond the cups; wherein the second pallet adapter is disposed in an inverted position with respect to the first pallet adapter, another end of each container disposed in each of the cups of the second pallet adapter; and further wherein the generally rectangular stacking index of each container mates with the generally rectangular upper portion of each cup of one of the first and second pallet adapters.

A seventh feature of the invention is a first generally rectangular pallet adapter comprising rows and columns of cups, the rows and columns of cups being substantially orthogonal to each other, each cup comprising a lower portion that is generally circular and an upper portion that is generally rectangular, the first pallet adapter including side walls located on its perimeter, the side walls extending upward beyond the cups; a plurality of containers, one end of each container disposed in each cup, each container including a generally rectangular stacking index; a detonation barrier disposed on the first pallet adapter wherein the detonation barrier comprises internal row partitions, internal column partitions, two end row partitions and two end column partitions, the internal row partitions and end row partitions being substantially orthogonal to the internal column partitions and end column partitions thereby defining rows and columns of rectangular openings wherein a number of rectangular openings in the detonation barrier is equal to a number of cups in the first pallet adapter and further wherein each container is disposed in a rectangular opening of the detonation barrier; and at least one cartridge disposed in at least one of the plurality of containers, the cartridge having a body with an area of maximum diameter, a rectangular opening of the detonation barrier being located radially outward from the area of maximum diameter of the cartridge body.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1A:
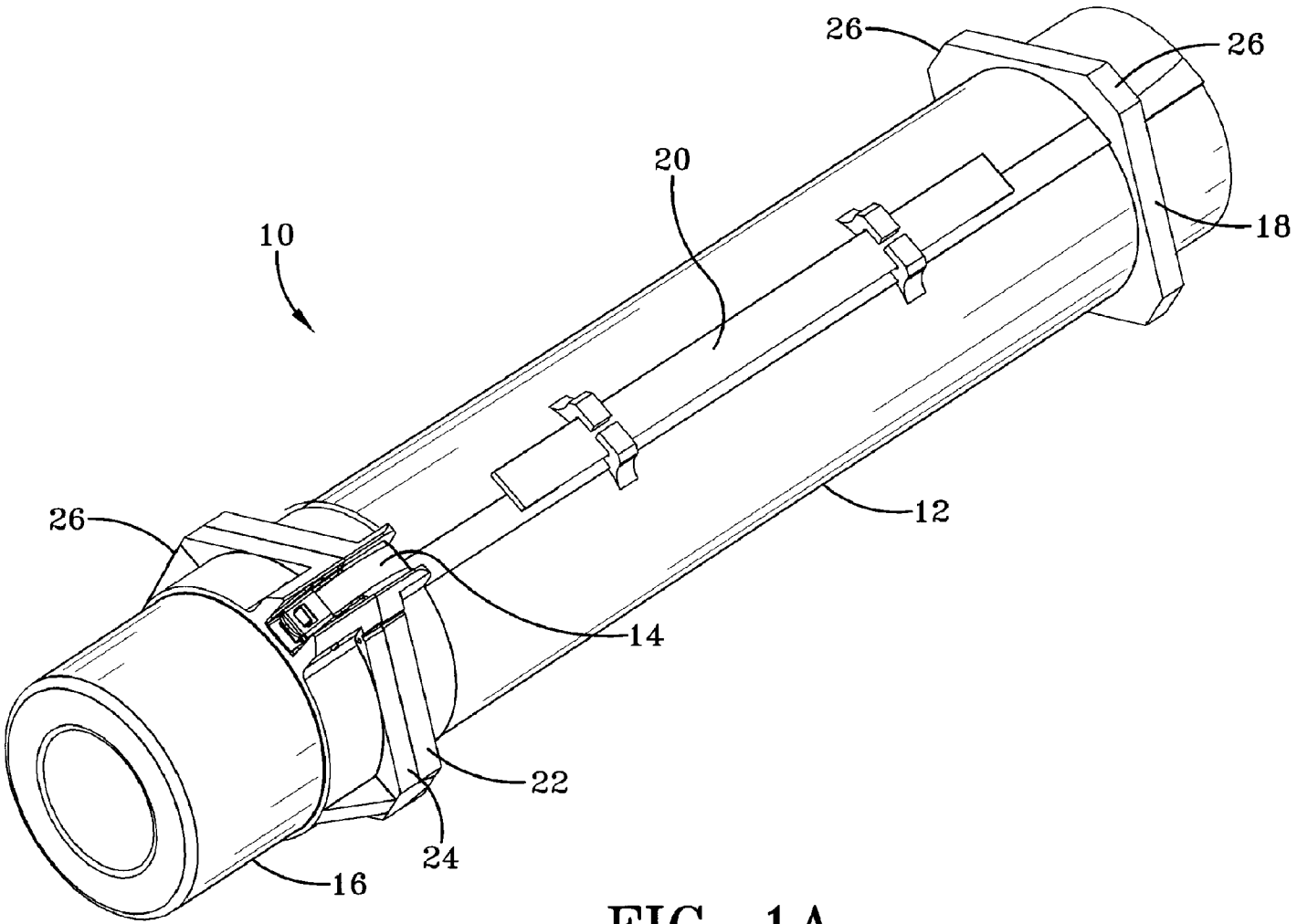
FIG. 1A is a perspective view of a MONOPAQ™ container for use as the primary packaging of a mortar round.
Figure 1B:
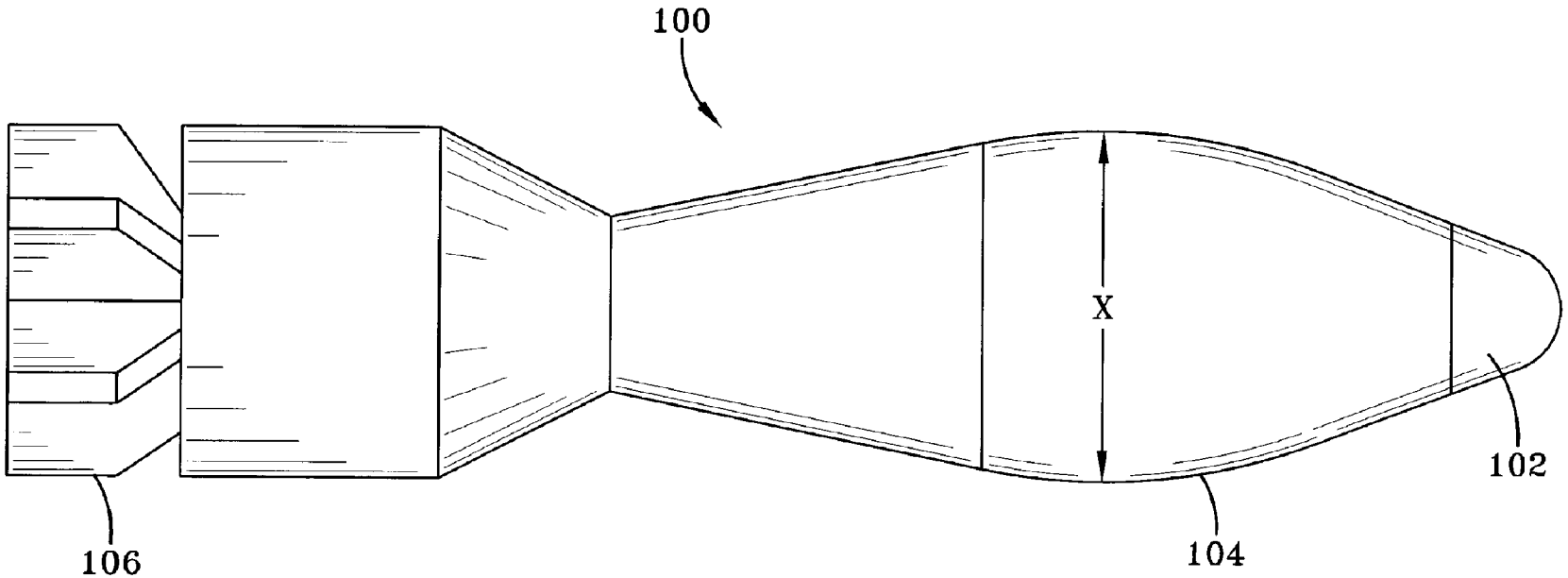
FIG. 1B is a side view of an exemplary mortar round stored in the MONOPAQ™ container of FIG. 1A.

FIG. 1 is a perspective view of a MONOPAQ™ container 10 for use as the primary packaging of a mortar cartridge (FIG. 1B). The container 10 is generally comprised of a cap 16 and a main body 12. The cap 16 and main body 12 have a generally cylindrical shape, augmented by a plurality of stacking indices 18, 22, 24. One stacking index 18 is located on the fuze or front end of body 12. Stacking index 22 is located on the rear end of body 12 and stacking index 24 is located on cap 16. When container 10 is assembled as shown in FIG. 1, stacking indices 22 and 24 join to form a single, double wide stacking index. Stacking indices 22, 24, 18 are generally rectangular in shape, with beveled corners 26. A latch assembly 14 secures the cap 16 to the body 12.

FIG. 1B is a side view of an exemplary high explosive mortar cartridge 100 stored in the MONOPAQ™ container 10 of FIG. 1A. Cartridge 100 comprises a fuze section 102 at a front portion, a body section 104 and a fin section 106 at a rear portion. The area of maximum diameter of the body section 104 is indicated by x in FIG. 1B. This diameter is the Borlette diameter. The cartridge 100 is loaded into container 10 with the fuze section 102 located at the end of the container having stacking index 18 and the fin section 106 located in the cap 16 end.

Figure 2A:
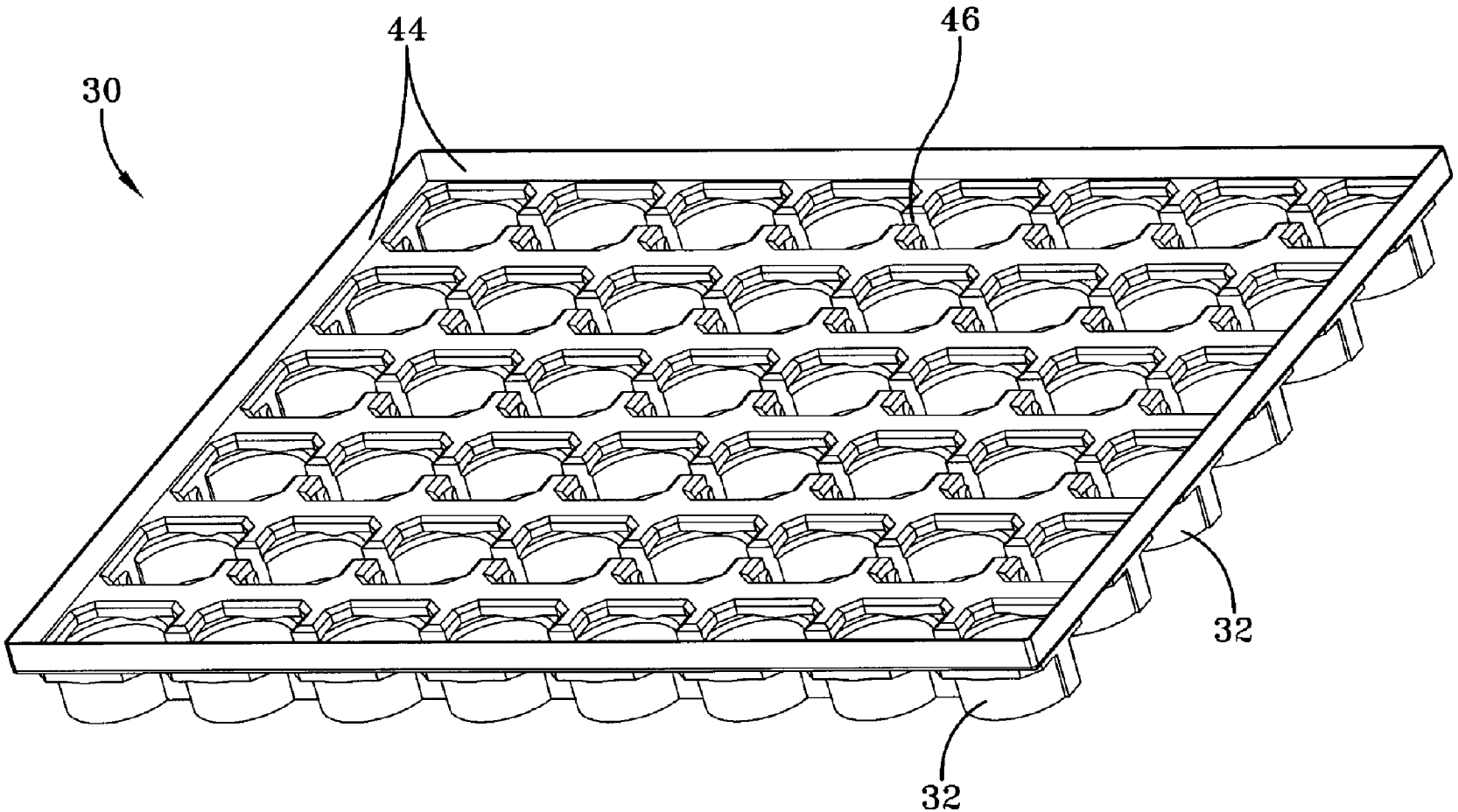
FIG. 2A is a perspective view of one embodiment of a pallet adapter.
Figure 2B:
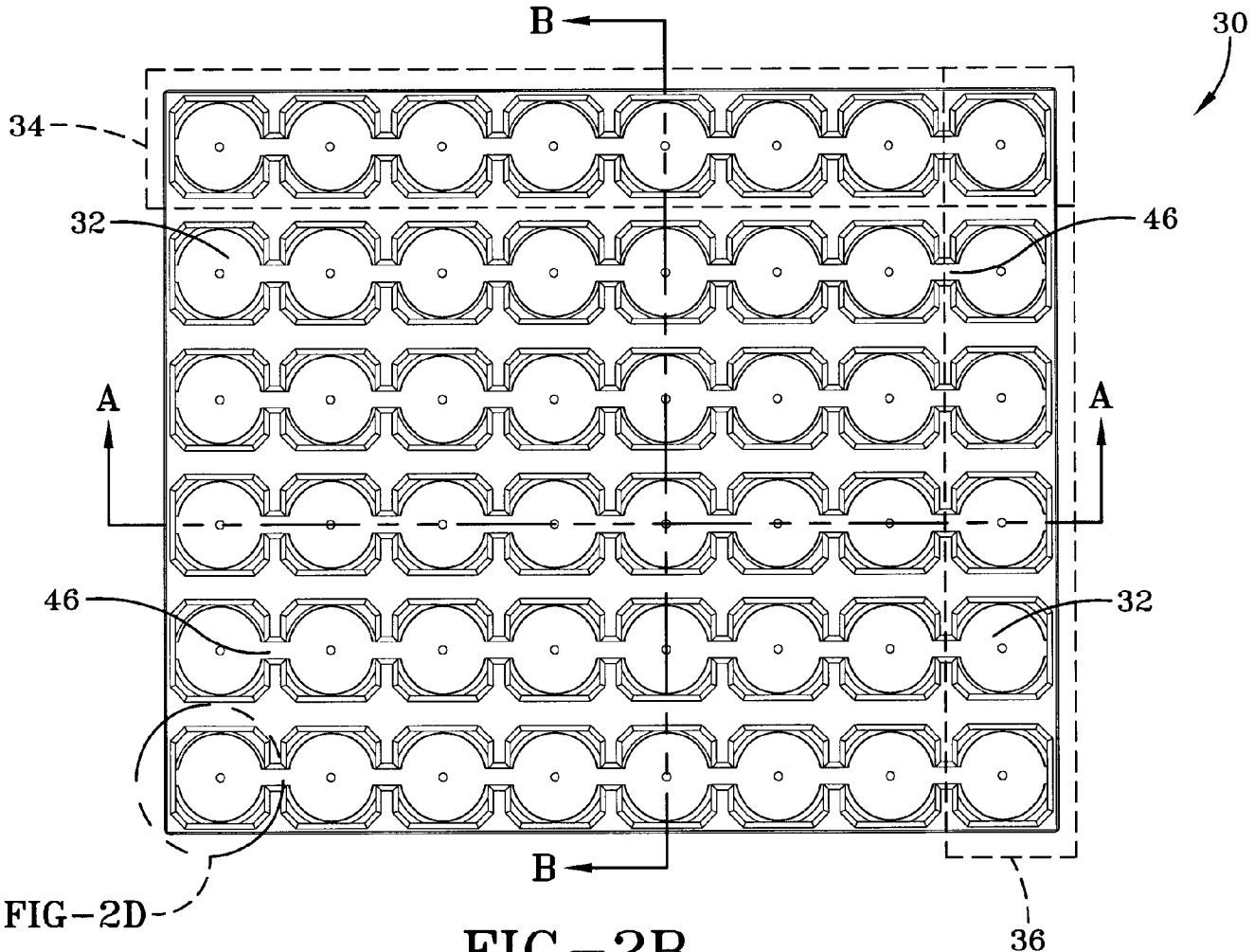
FIG. 2B is a top view of the pallet adapter of FIG. 2A.
Figure 2C:
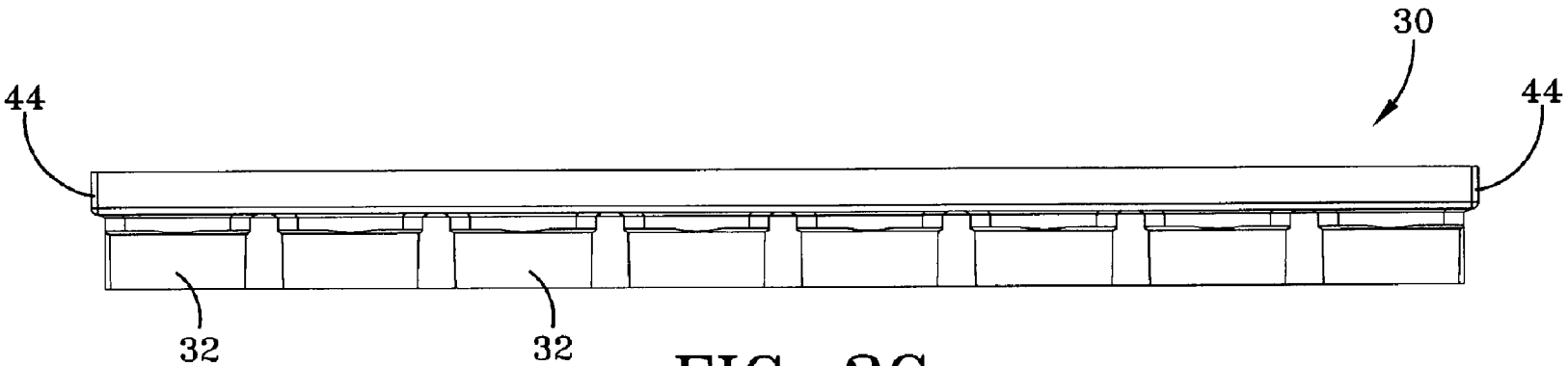
FIG. 2C is an end view of the pallet adapter of FIG. 2A.
Figure 2D:
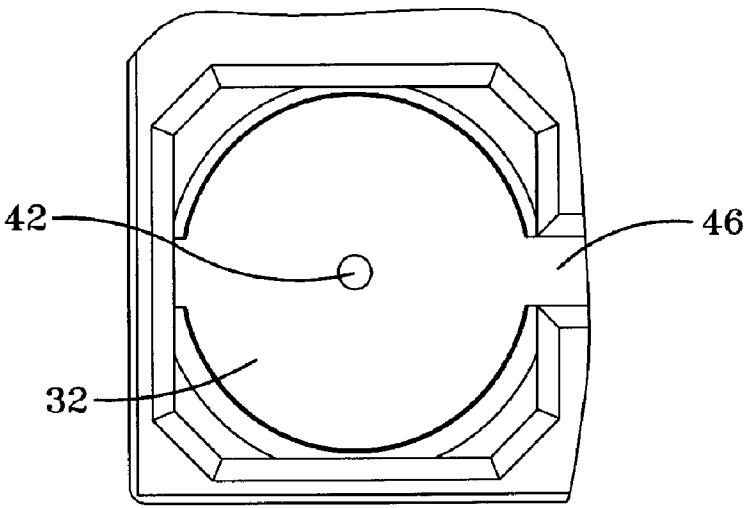
FIG. 2D is an enlarged view of a portion of FIG. 2B.
Figure 3A:
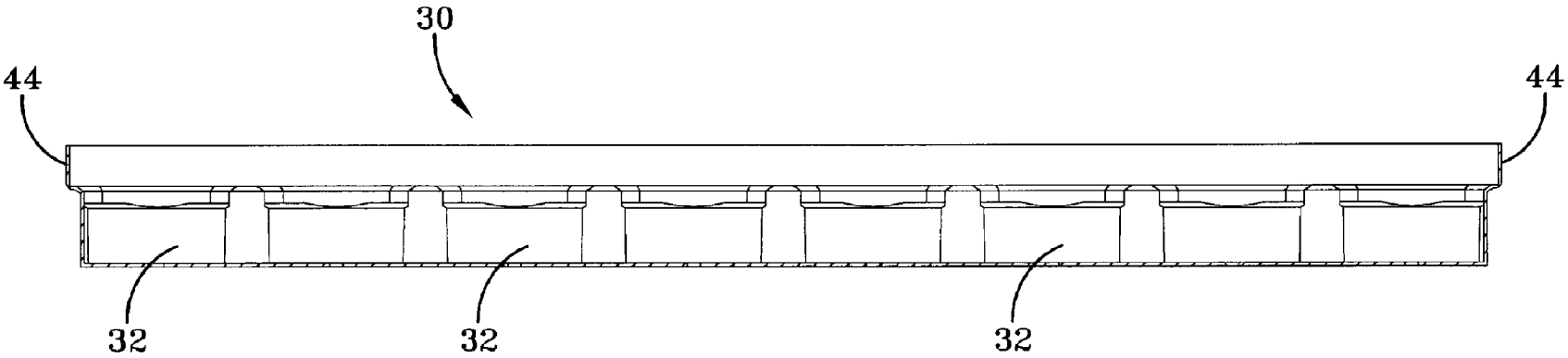
FIG. 3A is a section view of a pallet adapter taken along the line A-A of FIG. 2B.
Figure 3B:
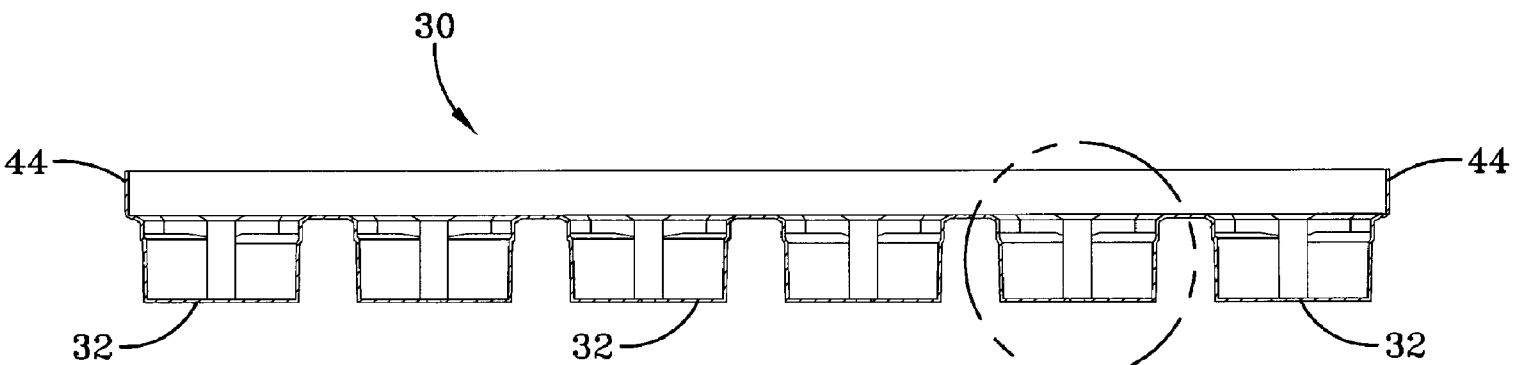
FIG. 3B is a section view of a pallet adapter taken along the line B-B of FIG. 2B.
Figure 3C:
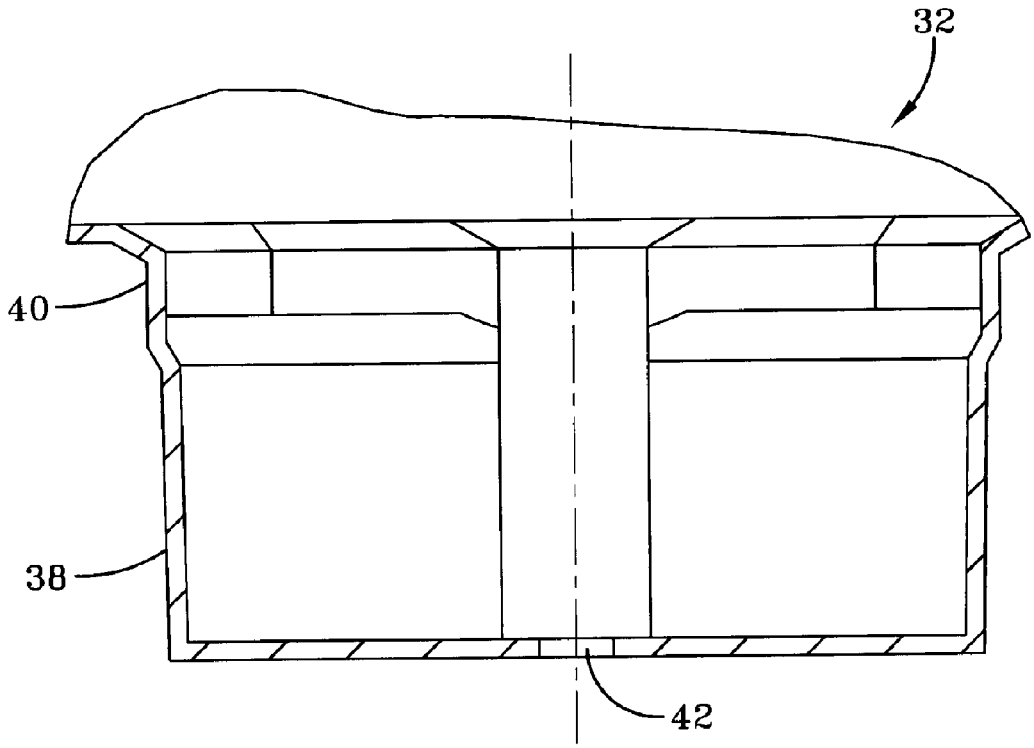
FIG. 3C is an enlarged view of a portion of FIG. 3B.

FIG. 2A is a perspective view of one embodiment of a pallet adapter 30 for holding MONOPAQ™ containers 10. FIG. 2B is a top view of the pallet adapter 30 of FIG. 2A. FIG. 2C is an end view of the pallet adapter 30 of FIG. 2A. FIG. 2D is an enlarged view of a cup 32 shown in FIG. 2B and FIG. 2C. FIG. 3A is a section view of a pallet adapter 30 taken along the line A-A of FIG. 2B. FIG. 3B is a section view of a pallet adapter 30 taken along the line B-B of FIG. 2B. FIG. 3C is an enlarged sectional view of a cup 32 shown in FIG. 3B.

Pallet adapter 30 has a generally rectangular shape and includes a plurality of cups 32 formed therein. Cups 32 are preferably formed in rows 34 and columns 36 (FIG. 2B). The rows 34 and columns 36 of cups are substantially orthogonal to each other. Each cup 32 includes a lower portion 38 that is generally circular and an upper portion 40 that is generally rectangular (FIG. 3C). Circular lower portion 38 preferably includes a drain opening 42 formed in a bottom surface thereof. Either the cap 16 end or body 12 end of container 10 is disposed in the circular lower portion 38. If the body 12 end of the container 10 is disposed in the circular lower portion 38, then the generally rectangular stacking index 18 of the body 12 will mate with the generally rectangular upper portion 40 of cup 32 to restrain movement of the container 12.

Pallet adapter 30 includes side walls 44 located on its perimeter. The side walls 44 extend upward beyond the cups 32. As best seen in FIGS. 2B and 2D, cups 32 in adjacent columns may be connected by channels 46. Channels 46 are features that facilitate the molding process of adapter 30. The pallet adapter 30 shown in FIG. 2B allows forty-eight (48) cylindrical MONOPAQ™ containers 10 to be unitized stably in a 6 row by 8 column palletization configuration. Of course, pallet adapters 30 with different number of rows and columns may be used, for example, 6×6, 5×4, 4×4, etc.

One method of making pallet adapter 30 is vacuum-forming using 0.2" thick high-density polyethylene material. The adapters 30 "cup" the MONOPAQ™ containers 10 to provide significant load stability. Two adapters 30 are used per pallet load, one under the bottom of the containers 10, resting on a wood pallet, and the second inverted on the top of the containers 10. If the containers 10 are placed with the cap 16 down, then the rectangular portions 40 on the top adapter 30 will engage the stacking indices 18 of the containers 10. On the other hand, if the containers 10 are placed with the cap 16 up, then the rectangular portions 40 on the bottom adapter 30 will engage the stacking indices 18 of the containers 10. This method allows the identical adapter 30 to be used on both the top and bottom for minimized cost. Use of the adapters 30 minimizes the use of extra wood dunnage and spare parts. Removal of the top adapter allows easy and immediate access to packaged ammunition.

Figure 4A:
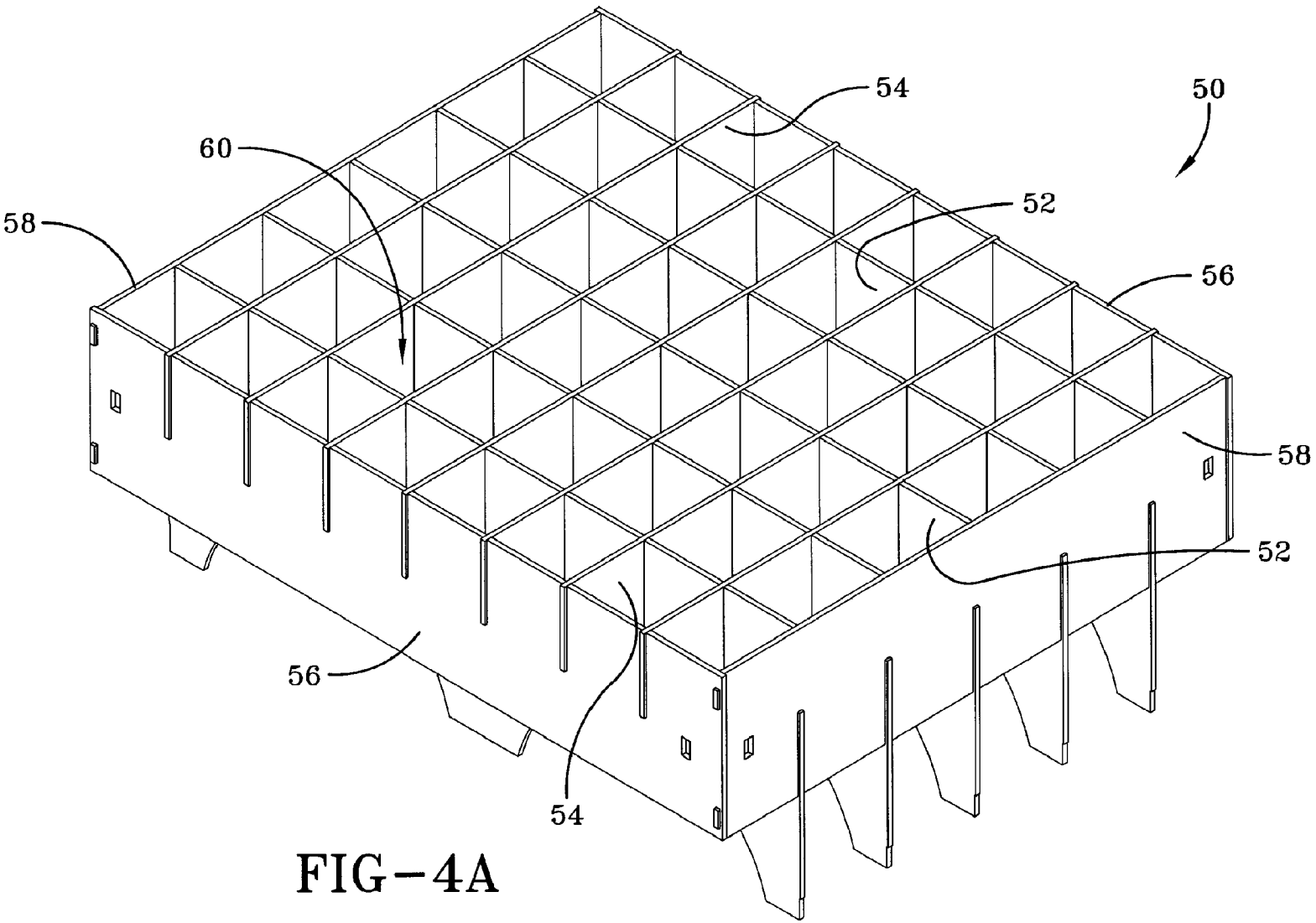
FIG. 4A is a perspective view of a detonation barrier.
Figure 4B:
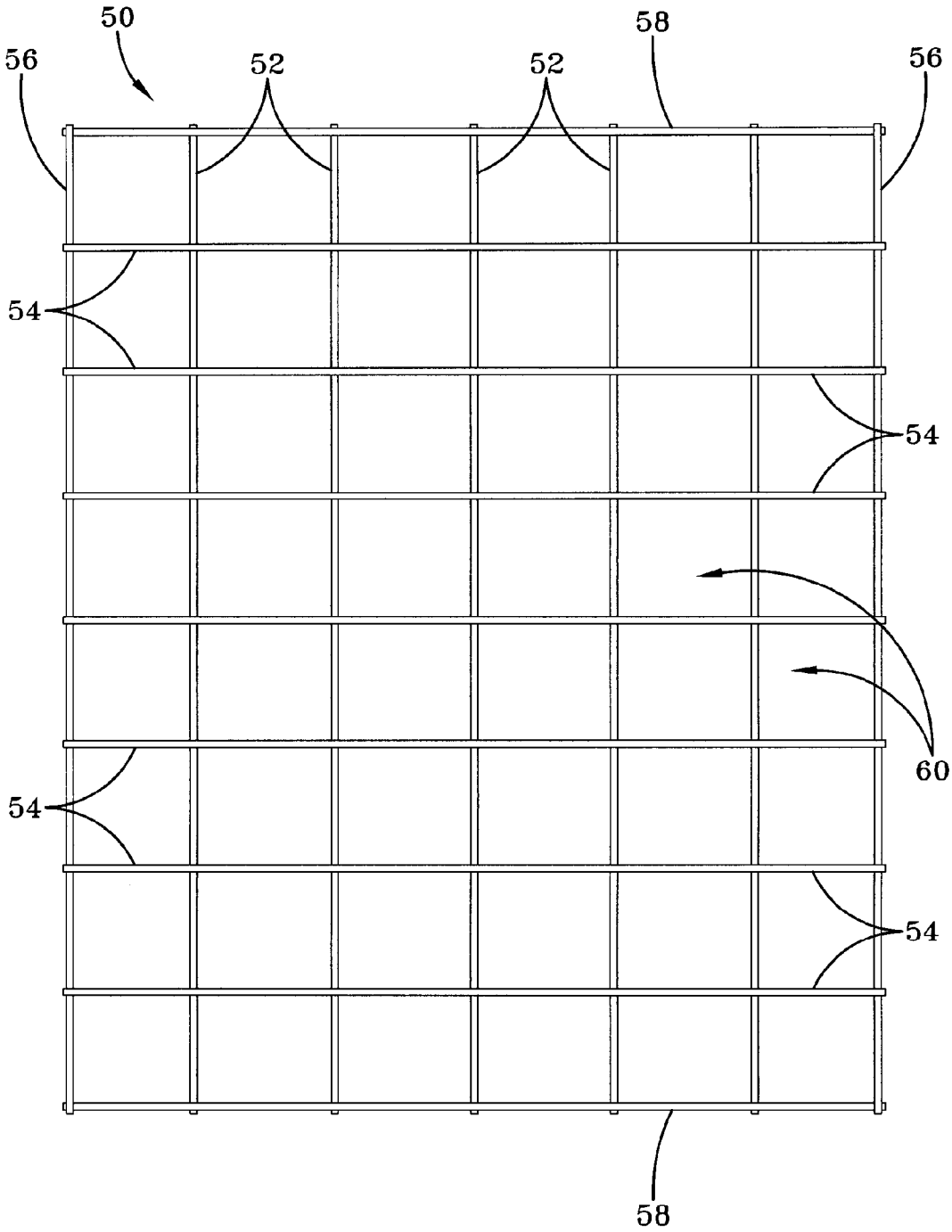
FIG. 4B is a top view of the detonation barrier of FIG. 4A.

Another aspect of the invention is a detonation barrier 50, shown in a perspective view in FIG. 4A and in a top view in FIG. 4B. Before containers 10 are placed in the cups 32 of bottom pallet adapter 30, detonation barrier 50 is placed on top of the bottom pallet adapter 30. Detonation barrier 50 is made of, for example, high density polyethylene. The detonation barrier 50 is an important element in assuring that containers 10 containing high explosive cartridges 100 pass the sympathetic detonation testing. The detonation barrier 50 successfully dampens and absorbs shock waves created by explosion of a cartridge 100 in a container 10. When a cartridge in a palletized container 10 explodes either accidentally or due to hostile action, detonation barrier 50 prevents adjacent, palletized high explosive cartridges from detonating.

Sympathetic detonation tests were conducted on high explosive cartridges 100 separated with the detonation barrier 50. The detonation barrier 50 effectively blockaded and absorbed the shock waves generated by the exploded donor cartridges and successfully prevented any of the adjacent cartridges from a chain detonation due to the explosion of the donor cartridge. The test results were exceptional. The detonation barrier 50 assures that the cartridges 100 in palletized containers 10 are fully in compliance with the sympathetic detonation requirements for a palletized load configuration.

The detonation barrier 50 comprises a set of high-density polyethylene, generally flat partitions (FIGS. 5-8) assembled to form a grid around each MONOPAQ™ container 10. In the embodiment shown, the detonation barrier 50 may contain up to forty-eight containers in 6 rows and 8 columns on a 45 inch×53 inch pallet configuration. However, detonation barriers with different number of rows and columns may be used, for example, 6×6, 5×4, 4×4, etc., on other sizes of pallets, e.g., 40 inches×48 inches. The partitions are slotted to lock together and the outside partitions have interlocks to keep a secure palletized load. To minimize the weight of the partitions, the design of the partitions is focused on providing maximum protection to the sympathetic detonation critical areas of the cartridges.

In particular, with the cartridges 100 disposed in containers 10 that are placed with cap 16 down in an adapter 30, the partitions surround the Borlette diameter (FIG. 1B at x) of the cartridges 100. That is, the rectangular openings 60 of the detonation barrier 50 are located radially outward from the area of maximum diameter of the body sections 104 of cartridges 100. The partitions are designed to be lightweight and easily assembled/disassembled without using special tools.

Figure 5A:
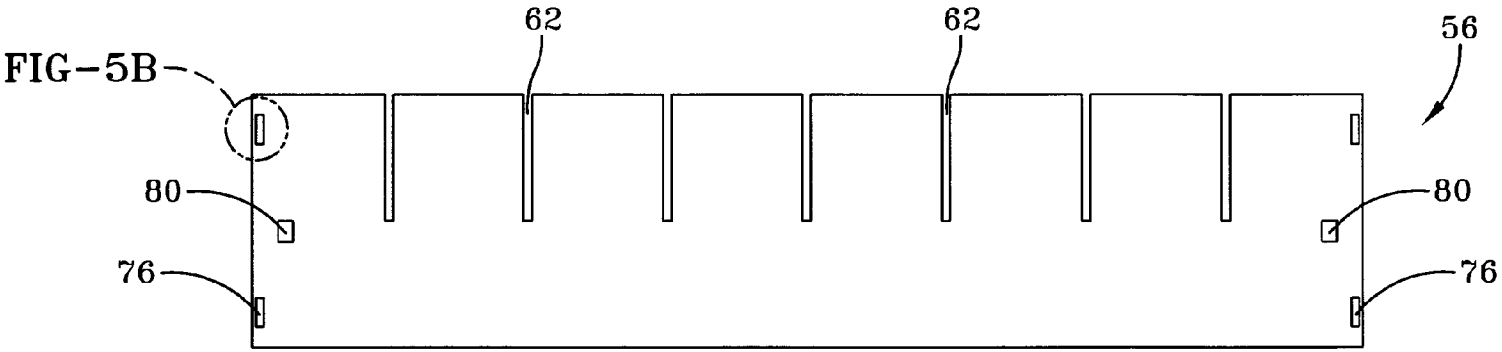
FIG. 5A shows an end row partition.
Figure 5B:
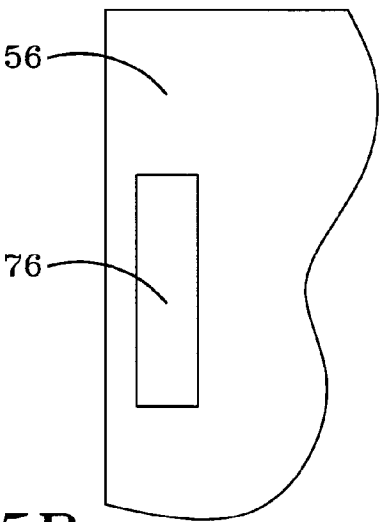
FIG. 5B is an enlarged view of a portion of FIG. 5A.
Figure 6A:
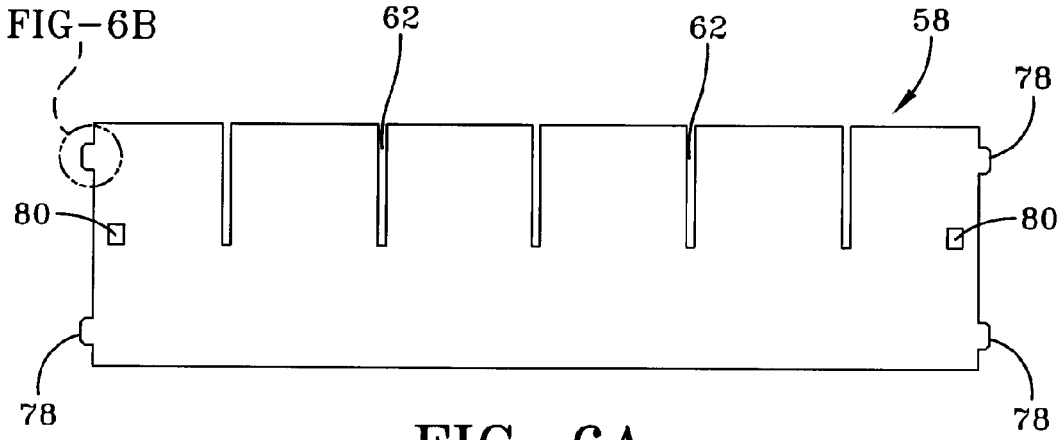
FIG. 6A shows an end column partition.
Figure 6B:
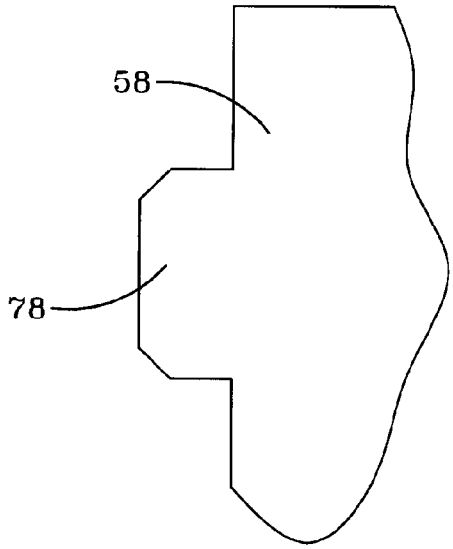
FIG. 6B is an enlarged view of a portion of FIG. 6A.
Figure 7A:
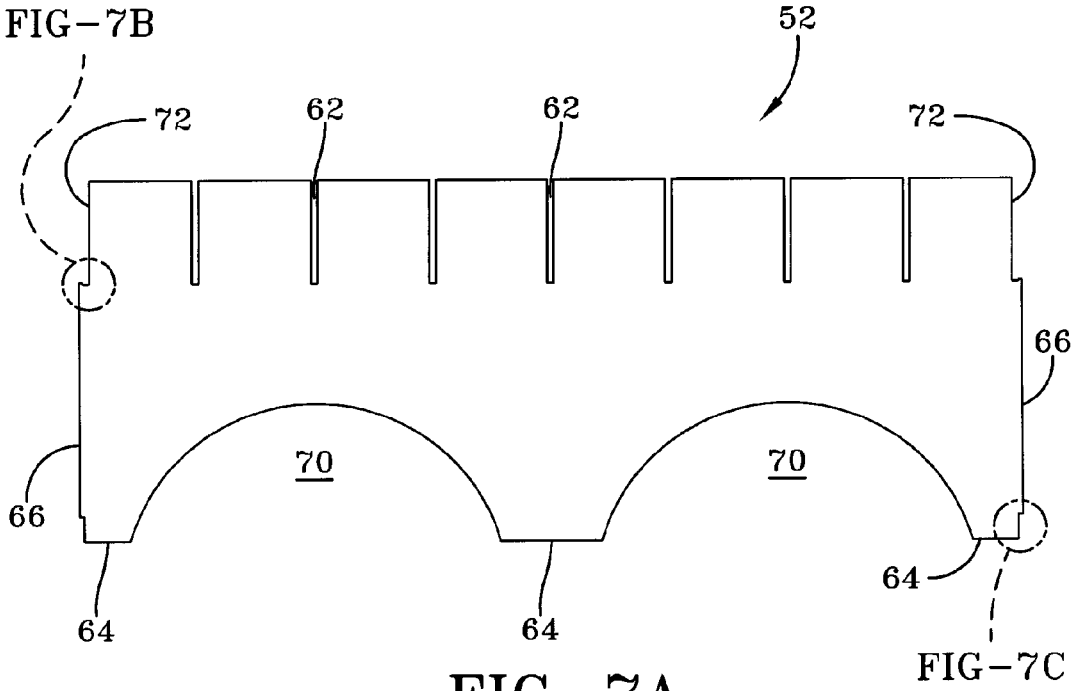
FIG. 7A shows an internal row partition.
Figure 7B:
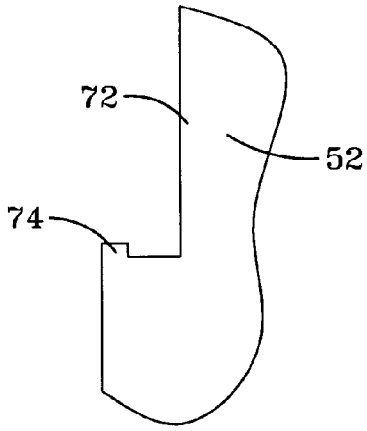
FIG. 7B is an enlarged view of a portion of FIG. 7A.
Figure 7C:
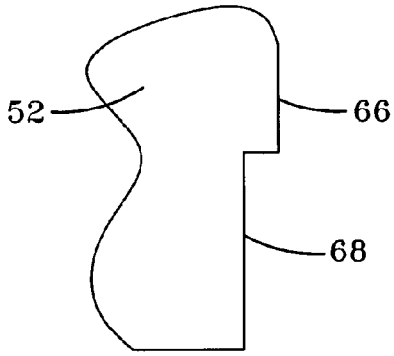
FIG. 7C is an enlarged view of another portion of FIG. 7A.
Figure 8:
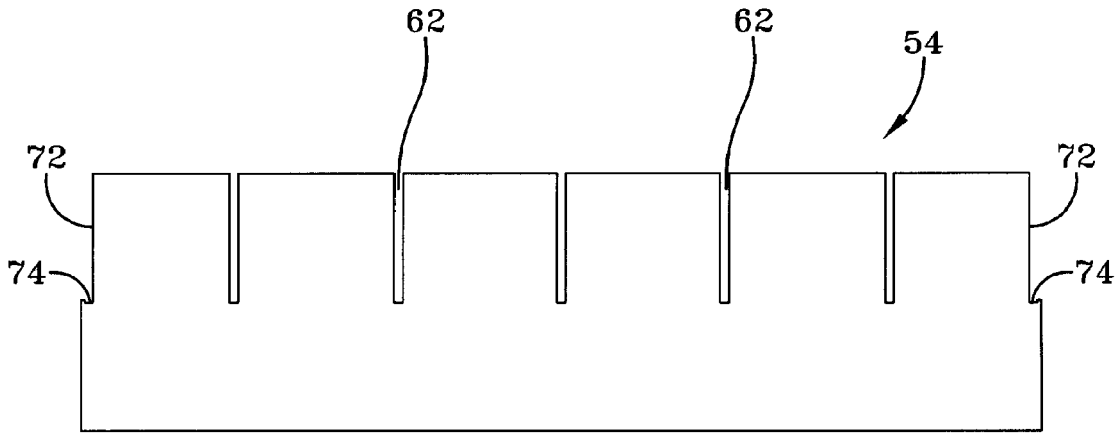
FIG. 8 shows an internal column partition.

FIG. 5A shows an end row partition 56. FIG. 5B is an enlarged view of a tab opening 76. FIG. 6A shows an end column partition 58. FIG. 6B is an enlarged view of a tab 78. FIG. 7A shows an internal row partition 52. FIG. 7B is an enlarged view of an upper side edge of partition 52. FIG. 7C is an enlarged view of a lower side edge of partition 52. FIG. 8 shows an internal column partition 54.

Referring now in more detail to FIGS. 4-8, the detonation barrier 50 comprises internal row partitions 52, internal column partitions 54, two end row partitions 56 and two end column partitions 58. The number of internal row and column partitions 52, 54 will vary depending on the quantity of containers 10 to be protected. The internal row partitions 52 and end row partitions 56 are substantially orthogonal to the internal column partitions 54 and end column partitions 58, thereby defining rows and columns of rectangular openings 60. When used in conjunction with a particular pallet adapter 30, the number of rectangular openings 60 in the detonation barrier 50 is equal to a number of cups 32 in the pallet adapter 30.

The internal row partitions 52, end row partitions 56, end column partitions 58 and internal column partitions 54 each have vertical slots 62 formed therein. The number of vertical slots 62 in the internal row partitions 52 and end row partitions 56 is one less than the number of columns of rectangular openings 60. The number of vertical slots 62 in the internal column partitions 54 and end column partitions 58 is one less than the number of rows of rectangular openings 60. The vertical slots 62 in each of the internal column partitions 54 mates with a corresponding vertical slot 62 in each of the internal row partitions 52. The end row partitions 56, end column partitions 58 and internal column partitions 54 are substantially rectangular in shape.

The bottom edges 64 and the lower side edges 66 of the internal row partitions 52 (FIG. 7A) provide the contact surface with the pallet adapter 30. To reduce the weight of the internal row partitions 52, two semicircular openings 70 are formed therein. To prevent the side walls 44 of the pallet adapter 30 from bulging outward, the lower side edges 66 of the internal row partitions 52 include a stepped portion 68 (FIG. 7C) that is inserted inside the side walls 44. The thickness of the end row partitions 56, end column partitions 58, internal column partitions 54 and internal row partitions 52 is a minimum of about 0.37 inches and preferably about 0.375 inches.

Each upper side edge of the internal column partitions 54 and each upper side edge of the internal row partitions 52 includes a stepped portion 72 (FIG. 7B) for receiving an end row partition 56 and an end column partition 58, respectively. Each stepped portion 72 includes a hook 74 to help retain the end row and end column partitions 56, 58.

Each end row partition 56 includes at least one tab opening 76 (FIG. 5B) adjacent each side edge. Each end column partition 58 includes at least one tab 78 (FIG. 6B) formed on each side edge, for insertion in the tab opening 76. Preferably, the number of tab openings 76 adjacent each side edge of each end row partition 56 is two and the number of tabs 78 formed on each side edge of each column partition 58 is two. In a preferred embodiment, each end row partition 56 and each end column partition 58 include a strap opening 80 formed adjacent each side edge. The strap openings 80 allow a strap that is wrapped around the detonation barrier 50 to avoid the ninety degree corners by passing through the strap openings 80.

Figure 9:
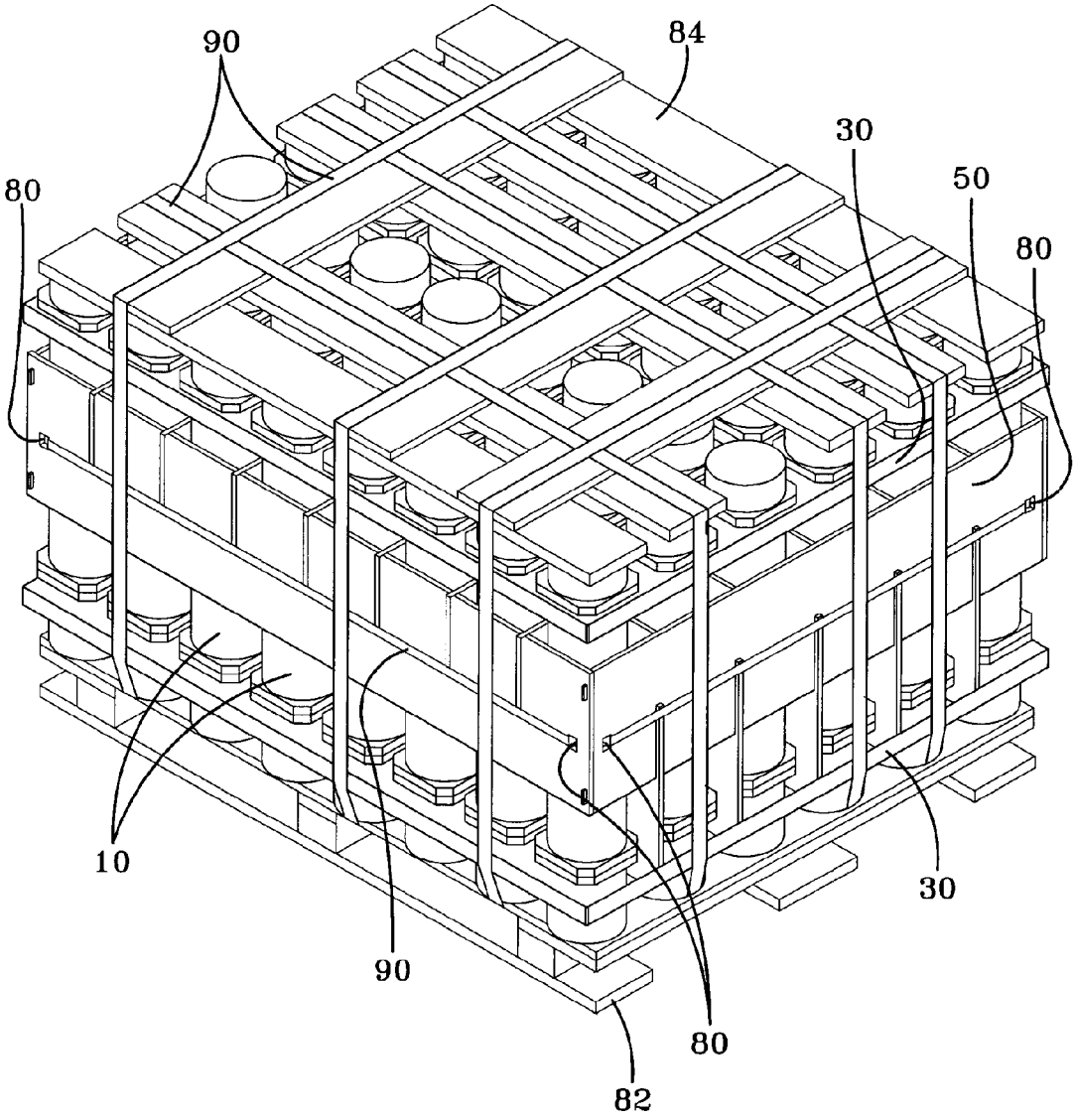
FIG. 9 is a perspective view of palletized containers.

FIG. 9 is a perspective view of palletized containers. Each palletized load begins with a 4-way entry wooden pallet 82, for example a 42 inch by 53 inch pallet. One pallet adapter 30 is placed on top of the wooden pallet 82. The detonation barrier 50 is then placed onto the pallet adapter 30. MONOPAQ™ containers 10 are placed in each of the cups 32 of the pallet adapter 30. Next, the matching pallet adapter 30 is placed upside down on top of the containers 10. As discussed above, depending on whether the containers 10 are placed with cap 16 up or down, either the rectangular portions 40 of the bottom pallet adapter or the rectangular portions 40 of the top pallet adapter will engage the stacking indices 18 of the containers 10. In FIG. 9, the containers 10 are placed with the cap 16 down. Therefore, the rectangular portions 40 of the top pallet adapter 30 will engage the stacking indices 18 of the containers 10. Finally, top dunnage 84 and strapping 90 are added to secure the load. It is noted that the horizontal strapping passes through the strap openings 80 in the detonation barrier 50.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for palletizing ammunition and preventing sympathetic detonation of a plurality of cartridges, comprising:

a first pallet adapter comprising rows and columns of cups, the rows and columns of cups being substantially orthogonal to each other, each cup comprising a lower portion that is generally circular and an upper portion that is generally rectangular, the first pallet adapter including side walls located along its entire perimeter, the side walls extending upward beyond the cups;

a plurality of containers for housing the cartridges, wherein one end of each container disposed in one corresponding cup of said cups;

wherein each container includes a body, a cap, and a plurality of generally rectangularly shaped stacking indices;

wherein the plurality of stacking indices include: a first stacking index that is located on a front end of the body; a second stacking index that is located on a rear end of the body; and a third stacking index that is located on the cap;

wherein upon assembly of each container, the second stacking index and the third stacking index join to form a single, double wide stacking index;

wherein the single, double wide stacking index of each container mates with the upper portion of each corresponding cup of said cups of the first pallet adapter;

a detonation barrier disposed on the first pallet adapter, wherein the detonation barrier dampens and absorbs shock waves created by an explosion of one or more cartridges within the container;

a second pallet adapter that is generally similar in construction and design to the first pallet adapter;

wherein the second pallet adapter includes rows and columns of cups, wherein the rows and columns of cups being substantially orthogonal to each other, wherein each cup comprising a lower portion that is generally circular and an upper portion that is generally rectangular, wherein the second pallet adapter includes side walls located along its entire perimeter, and wherein the side walls extend downward beyond the cups; and wherein the second pallet adapter is disposed in an inverted position with respect to the first pallet adapter, wherein the first stacking index that is located on the front end of the body, mates with the upper portion of each corresponding cup of said cups of the second pallet adapter.

2. The apparatus of claim 1 wherein the detonation barrier comprises internal row partitions, internal column partitions, two end row partitions and two end column partitions, the internal row partitions and end row partitions being substantially orthogonal to the internal column partitions and end column partitions thereby defining rows and columns of rectangular openings wherein a number of rectangular openings in the detonation barrier is equal to a number of cups in the first pallet adapter and further wherein each container is disposed in a rectangular opening of the detonation barrier.

3. The apparatus of claim 2 wherein the internal row partitions, end row partitions, end column partitions and internal column partitions each have vertical slots formed therein, a number of vertical slots in the internal row partitions and end row partitions being one less than a number of columns of rectangular openings and a number of vertical slots in the internal column partitions and end column partitions being one less than a number of rows of rectangular openings.

4. The apparatus of claim 2 wherein the end row partitions, end column partitions and internal column partitions are substantially rectangular in shape and wherein a bottom edge of each internal row partition includes two semicircular openings therein.

5. The apparatus of claim 2 wherein a thickness of the end row partitions, end column partitions, internal column partitions and internal row partitions is a minimum of about 0.37 inches.

6. The apparatus of claim 2 wherein a vertical slot in each of the internal column partitions mates with a corresponding vertical slot in each of the internal row partitions.

7. The apparatus of claim 6 wherein each side edge of the internal column partitions and each side edge of the internal row partitions includes a stepped portion for receiving an end row partition and an end column partition, respectively.

8. The apparatus of claim 7 wherein each end row partition includes at least one tab opening adjacent each side edge and each end column partition includes at least one tab formed on each side edge, for insertion in the at least one tab opening.

9. The apparatus of claim 8 wherein a number of tab openings adjacent each side edge of each end row partition is two and a number of tabs formed on each side edge of each column partition is two.

10. The apparatus of claim 8 wherein each end row partition and each end column partition include a strap opening formed adjacent each side edge.

11. The apparatus of claim 7 wherein each stepped portion includes a hook.

12. The apparatus of claim 2 further comprising at least one cartridge disposed in at least one of the plurality of containers, the cartridge having a body with an area of maximum diameter, a rectangular opening of the detonation barrier being located radially outward from the area of maximum diameter of the cartridge body.

* * * * *